United States Patent [19]

Robinson

[11] 4,235,032

[45] Nov. 25, 1980

[54] POINT-OF-SALES DISPLAY

[76] Inventor: Robert G. Robinson, 366 N. Broadway, Jericho, N.Y. 11753

[21] Appl. No.: 35,788

[22] Filed: May 3, 1979

[51] Int. Cl.[3] ..... G09F 1/08

[52] U.S. Cl. ..... 40/539; 40/124.1

[58] Field of Search ..... 40/539, 538, 124.1, 40/606

[56] References Cited

U.S. PATENT DOCUMENTS

| | | | |
|---|---|---|---|
| 2,345,913 | 4/1944 | Bishop | 40/606 |
| 2,631,046 | 3/1953 | Stephens | 40/124.1 |
| 2,920,410 | 1/1960 | Angerhn | 124.1 X |
| 3,481,061 | 12/1969 | Julin | 40/124.1 |

*Primary Examiner*—Gene Mancene
*Assistant Examiner*—Wenceslao J. Contreras
*Attorney, Agent, or Firm*—Bauer & Amer

[57] ABSTRACT

A cooperating arrangement of two side panels and a middle interconnecting panel therebetween forming a self-standing display due to the H-shape presented by the bottom edges of said panels in relation to a floor or support surface, and wherein from said erect condition the panels fold into a more compact condition more suitable for storage and shipment of the display.

1 Claim, 4 Drawing Figures

POINT-OF-SALES DISPLAY

The present invention relates to point-of-sales displays, of the type usually of cardboard construction material, and more particularly to improvements for imparting a sturdy, self-standing condition in such a display while allowing it nevertheless to be readily converted, merely by being folded, into an optimum, nominally-sized condition suitable for storage and shipping.

As understood, and as exemplified by the folding panel construction of U.S. Pat. No. 3,727,874, it is already known that flaps, provided rearwardly of a display panel and foldable transversely thereof, can advantageously be used to hold the display panel erect and, as such, enhance the use thereof either alone to effectively present a commercial message, or enable use of the panel in conjunction with a product at an appropriate point-of-sales location. Heretofore, however, the referred to flaps were not effectively utilized so as to contribute to the visual impact of the display, or in any other way in the visual presentation thereof, being limited to merely functioning as "legs" for the structure.

Broadly, it is an object of the present invention to provide a product display, particularly suitable for point-of-sales use, overcoming the foregoing and other shortcomings of the prior art. Specifically, it is an object to provide graphically illustrated and profile-related panels in a product display that both structurally and visually significantly contributes to the effective use of the display.

A product point-of-sales display demonstrating objects and advantages of the present invention is of the type that is unfoldable from a compact storage condition into an erect self-standing condition and, to this end, the display includes a rectangular interconnecting member having attaching flaps along opposite sides thereof delineated by vertically oriented fold lines spaced inwardly and along said opposite sides. What is interconnected by the member just referred to are a cooperating pair of product-display panels disposed in facing relation to each other by each being adhesively secured to a cooperating one of said attaching flaps. As a result, the bottom edges of the pair of product-display panels and the interconnecting member cooperate in said erect condition of the display to define an H-shaped configuration for establishing contact with a support surface so as to render the display self-standing. Additionally, the product-display panels are foldable about the fold lines of said attaching flaps so that they move bodily upon the interconnecting member preparatory to providing the display with said compact storage condition. Once all panels are in one plane, as just noted, they are further folded, accordion-style, about fold lines of horizontal orientation in relation to the interconnecting member and the product-display panels that are provided in spaced-apart locations therein to thus assume an optimum compact storage condition that is particularly suited for storage and shipment of the display.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
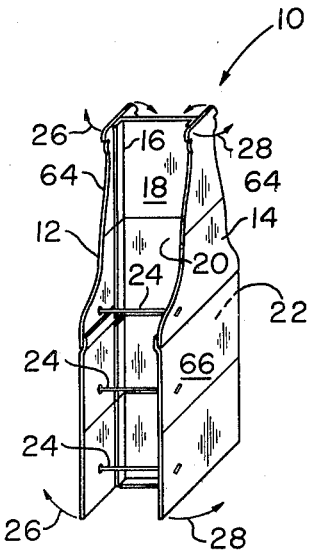
FIG. 1 is a perspective view of the within improved point-of-sales display in its unfolded erect, self-standing condition. By progressive examination of succeeding FIGS. 2 and 3, it is illustrated how the display is folded into a compact condition for storage and shipping.

The within display, generally designated 10, is of the type that is useful at a point-of-sales location in supermarkets and other retail outlets to assist, by functioning as an attractive display, in launching the sales of the products associated therewith. With the clear understanding that display 10 hereof is not limited to being used only in connection with a bottled beverage, such use is particularly suitable for the display 10 and is therefore described in connection with this product. As such, display 10, fabricated of cardboard or similar construction material, includes two side panels 12 and 14 appropriately die-cut or otherwise provided with a profile of a bottle particularly used for beverages. In a manner as will be described in detail subsequently, the panels 12 and 14 are foldably attached, as at opposite vertically oriented fold lines 16, provided along opposite sides of a middle panel 18 that, in the self-standing erect condition of display 10 as illustrated in FIG. 1, extends in spanning relation between the side panels 12 and 14. In the condition illustrated in FIG. 1 the side panels 12, 14 and 18 cooperate to form on opposite sides of the middle panel 18 two display compartments 20 and 22 for cases of the bottled beverage to be sold in association with the display 10. To assist in folding the side panels 12 and 14 in perpendicular relation to the middle panel 18 and thus to form what is essentially in cross-section an "H" shape, use is made of elastomeric strings, individually and collectively designated 24, which are connected in spanning relation between facing halves of the side panels 12 and 14. Although the strings 24 are located in the compartment 20 they do not seriously interfere with the physical placement of cases or otherwise packaged quantities of the product associated with the display 10.

Figure 2:
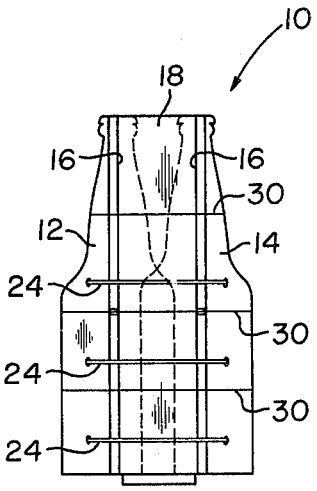
FIG. 2 is a front elevational view of the within display which, as above noted, illustrates the display after the side panels thereof are folded against the middle panel thereby providing a flat planar condition to the display.
Figure 3:
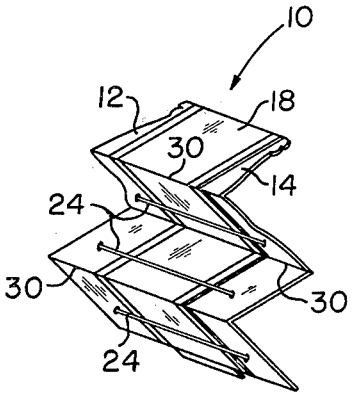
FIG. 3 is a perspective view illustrating how the display is accordion-folded into its compact condition convenient for storage and shipping.

A noteworthy aspect of the display 10 is its ability, by folding of the various panels 12, 14 and 18, to be placed into a compact condition more suitable than the erect condition of FIG. 1 for storage and shipping of the display. This noteworthy aspect of display 10 is readily understandable by progressive examination of FIGS. 1, 2 and 3. More particularly, as illustrated by progressive examination of FIGS. 1 and 2, the side panels 12 and 14 are adapted to be folded about the vertically oriented fold lines 16 in the folding direction 26, 28 bodily against the middle panel 18. Because of the lateral size of the panels 12 and 14 one of these panels is folded first, followed by the other, so that the peripheral edges that come together overlap rather than jam into each other. Following the folding just noted the display 10 is then in a flat planar condition as illustrated in FIG. 2. As such, the display is then ready to be folded accordion-style along the spaced apart horizontally oriented fold lines individually and collectively designated 30. The ability of the display 10 to partake of accordion folding about the fold lines 30 is illustrated in FIG. 3.

For completeness' sake it is noted that the display 10 is of course readily unfolded from its compact storage condition into its erect condition in which it functions as an effective point-of-sales display as illustrated in FIG. 1 by merely reversing the procedure just described. It is further to be noted that since the typical size for the display 10 contemplated for use calls for a height that may be as much as ten feet and other dimensions proportional therewith, that the ability of the display 10 to be readily converted back and forth between its FIGS. 1 and 3 conditions is of significant commercial importance and is in sharp contrast to prior art difficulties in handling large-sized point-of-sales displays.

Figure 4:
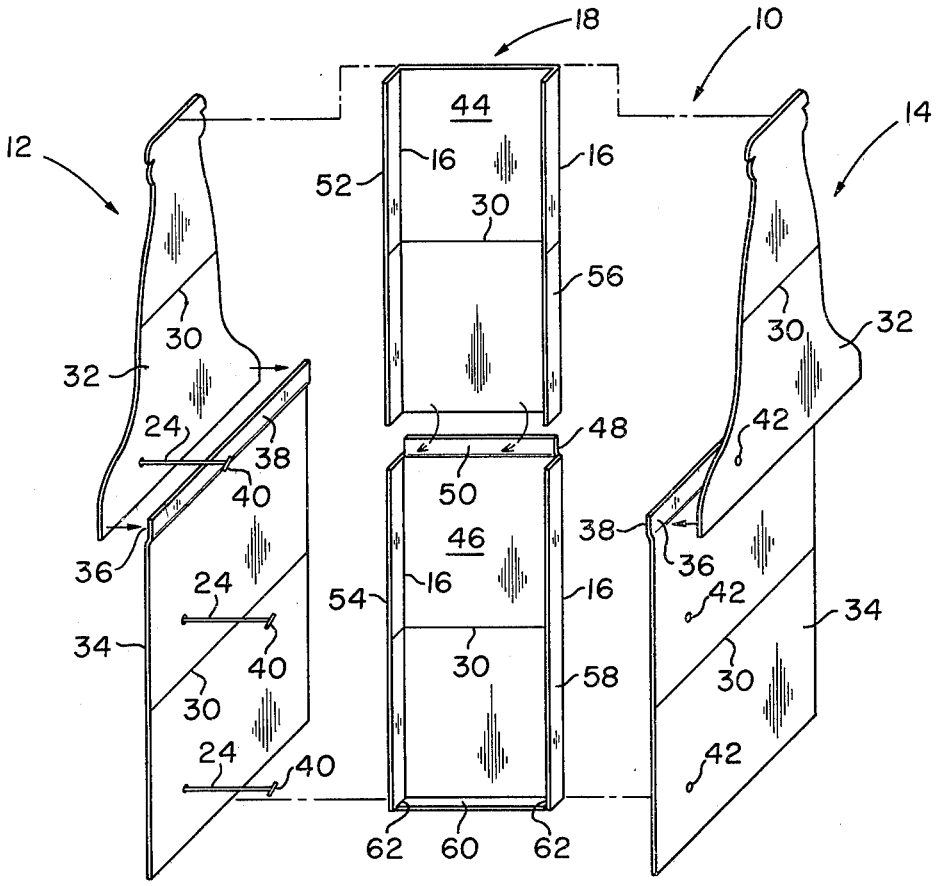
FIG. 4 is a perspective exploded view of the components and their cooperative relation of a preferred embodiment of the within display.

Reference is now made to FIG. 4 illustrating the construction of a preferred embodiment of display 10. Because of the size it is more convenient to make the side panels 12, 14 and middle panel 18 in two sections. Thus, side panels 14 consists of an upper section 32 and lower section 34 adhesively secured, as at 36, using an attaching flap 38 along the upper portion of lower section 34. Completing side panel 12 are the previously noted horizontally oriented fold lines 30, one generally located across the middle of upper section 32 and the other across the middle of bottom section 34.

For brevity sake, since the panels 12 and 14 are identical, the structural features just noted in connection with side panel 12 that are identically provided in side panel 14 are denoted by the same reference numerals. It is convenient at this point in the description to also note that provided at opposite ends of the elastomeric strings 24 are metal tips 40 which are inserted in practice through openings 42 in the side panels and are effective, in a well understood manner, in preventing inadvertent detachment of the strings from the panels. While the strings 24 undoubtedly are useful for projecting the side panels 12 and 14 into their transverse and perpendicular relation to middle panel 18, this same function can be achieved manually and, if achieved in this manner, the strings 24 can therefore be dispensed with.

Completing the construction of the preferred embodiment of display 10 as illustrated in FIG. 4 is middle panel 18 which also, as already noted, is preferably made as a top section 44 and a bottom section 46, these two sections being adhesively secured together, as at location 48, using an attaching flap 50 provided along the upper portion of the bottom section 46. The previously noted vertically oriented fold lines 16 which, as illustrated, are provided as two aligning fold lines in the top and bottom sections 44, 46, are formed as a consequence of providing attaching flaps 52, 54 along one side of panel 18 for completing attachment thereof to the side panel 12 and similar flaps 56, 58 for attaching the side panel 14 to the construction. The bottom flap 60 on bottom section 46 assists in limiting movement in the flaps 12 and 14 towards each other in the direction of urgency of the strings 24 wherein the opposite sides of flap 60 function as stops for the flaps 54 and 58 at locations of an abutment 62 therebetween. The function provided by flap 60, however, is not critical since the strings 24 are selected so that there is only nominal urgency therein when the side panels 12 and 14 assume their position transversely of the spanning or middle panel 18.

From the foregoing description it should be readily appreciated that there has been described herein a point-of-sales display 10 characterized by simplified construction which is self-standing and presents a highly attractive display which, as described herein, consists not only of the bottle-shaped profiles 64 that are embodied in the side panels 12, 14, but also in the graphic illustrations which it will be understood are readily imprinted on the display or outwardly facing surfaces 66 of each of the side panels 12, 14. Further, and also as has been described herein, display 10 has the attribute of being readily converted, despite its extensive size in use into a condition of substantially reduced size and bulk that is particularly suitable for storage and shipping.

A latitude of modification, change and substitution is intended in the foregoing disclosure and in some instances some features of the invention will be employed without a corresponding use of other features. Exemplary of what is contemplated within the inventive concept hereof would be fabricating the components as a single construction unit, rather than as two cooperating top and bottom sections, embodying different profiles or other display features in the two panels 12 and 14, and other such modifications, changes and substitutions. Accordingly, it is appropriate that the appended claims be construed broadly and in a manner consistent with the spirit and scope of the invention herein.

What is claimed is:

1. A product point-of-sales display of the type that is unfoldable from a compact storage condition into an erect self-standing condition, said display comprising a rectangular interconnecting member having attaching flaps along opposite sides thereof delineated by vertically oriented fold lines spaced inwardly and along said opposite sides, a cooperating pair of product-display panels of cardboard construction material each die-cut about its perimeter in the shape of a selected product and disposed in facing relation to each other by each being adhesively secured to a cooperating one of said attaching flaps, said bottom edges of said pair of product-display panels and said interconnecting member cooperating in said erect condition of said display to define an H-shaped configuration for establishing contact with a support surface so as to render said display self-standing, plural elastomeric means connected in spanning relation between locations on said product-display panels so as to exert a biasing force effective to urge said product-display panels into said H-shaped configuration, said product-display panels being foldable about said fold lines of said attaching flaps bodily upon said interconnecting member in opposition to said biasing force of said elastomeric means preparatory to providing said display with said compact storage condition, and fold lines of horizontal orientation in relation to said interconnecting member and said product-display panels provided in spaced-apart locations therein, whereby said display is adapted to be accordion folded along said horizontal fold lines for completing said compact storage condition for said display and for maintaining said opposition to said elastomeric means biasing force so as to obviate the inadvertent unfolding movement of said product-display panels into said H-shaped configuration while said display is in said compact storage condition.

* * * * *